US006003333A

United States Patent [19]

Stevens

[11] Patent Number: 6,003,333

[45] Date of Patent: Dec. 21, 1999

[54] HUMAN EARLOBE PROTECTOR

[76] Inventor: Jo Ann Stevens, P.O. Box 550021, Atlanta, Ga. 30355

[21] Appl. No.: 08/971,286

[22] Filed: Nov. 17, 1997

Related U.S. Application Data

[63] Continuation of application No. 08/617,035, Mar. 18, 1996, abandoned.

[51] Int. Cl.[6] ..... A44C 7/00

[52] U.S. Cl. ..... 63/12; 63/14.9

[58] Field of Search ..... 63/12, 13, 14.1, 63/14.3, 14.9; 604/306, 307; 602/60, 61, 74, 53

[56] References Cited

U.S. PATENT DOCUMENTS

| | | | |
|---|---|---|---|
| 4,067,341 | 1/1978 | Ivey | 128/330 |
| 4,274,416 | 6/1981 | Sorensen | 63/12 |
| 4,353,370 | 10/1982 | Evans | 63/12 |
| 4,501,050 | 2/1985 | Fountoulakis | 24/155 |
| 4,593,540 | 6/1986 | Cuvar et al. | 63/12 |
| 4,761,971 | 8/1988 | Freier . | |
| 4,774,817 | 10/1988 | Beam et al. . | |
| 4,829,788 | 5/1989 | DiDomenico . | |
| 4,917,690 | 4/1990 | Hunger . | |
| 4,943,274 | 7/1990 | Edwards . | |
| 4,974,430 | 12/1990 | Turner | 63/DIG. 1 X |
| 5,081,853 | 1/1992 | Salyer | 63/DIG. 1 X |
| 5,444,994 | 8/1995 | Poortinga et al. | 63/14.3 |
| 5,537,841 | 7/1996 | Bradvica | 63/12 |
| 5,638,701 | 6/1997 | Dempsey | 63/12 |
| 5,769,995 | 6/1998 | Greyerbiehl | 63/12 X |

*Primary Examiner*—Kien T. Nguyen
*Attorney, Agent, or Firm*—D. Douglas Price; Jacobson, Price Holman & Stern

[57] ABSTRACT

An apparatus for temporarily repairing a pierced human earlobe that is entirely cleft through from the pierced hole, or an earlobe whereupon the pierced hole is so enlarged as to preclude the wearing of pierced or post-type earrings, is provided by a strip of flexible, polymeric, essentially transparent, non-allergenic material, adhering to the front, bottom and back of the earlobe and forming a structural bridge over the damaged tissue, whereby the post of an earring may be inserted in the location of the original pierce and the weight of the earring is transferred into the earlobe tissue by the adhesive-coated material.

1 Claim, 7 Drawing Sheets

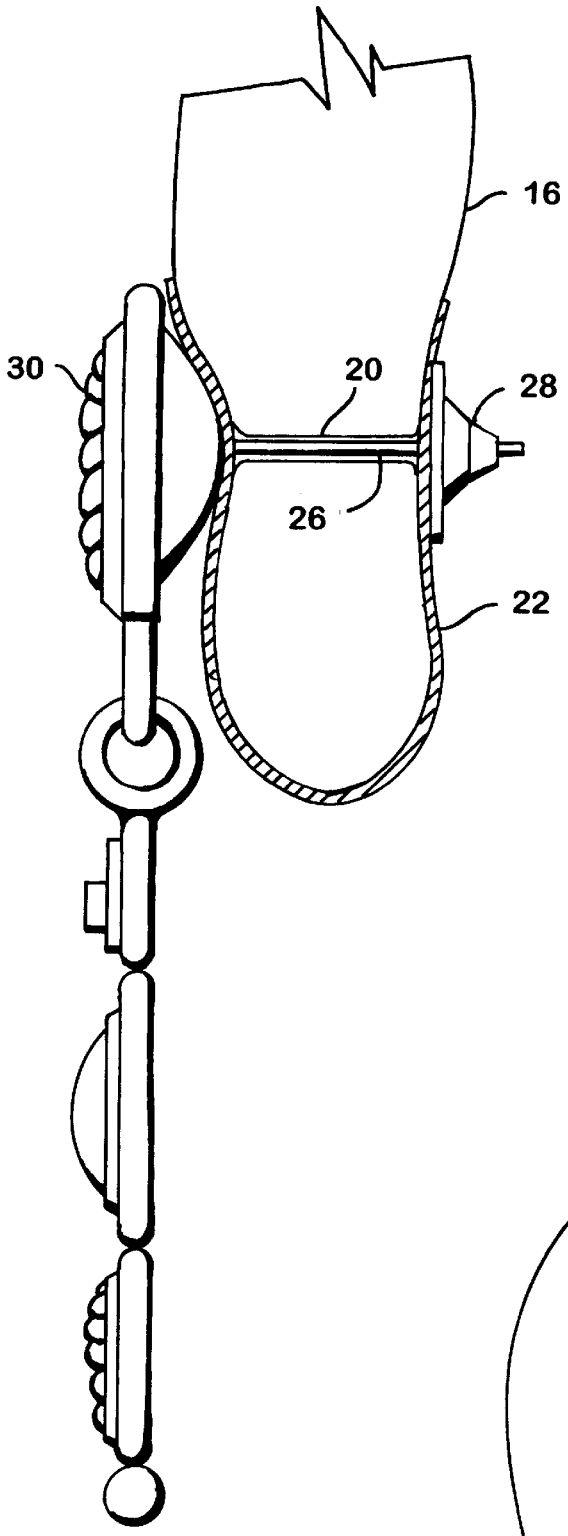
FIG 5
FIG 6
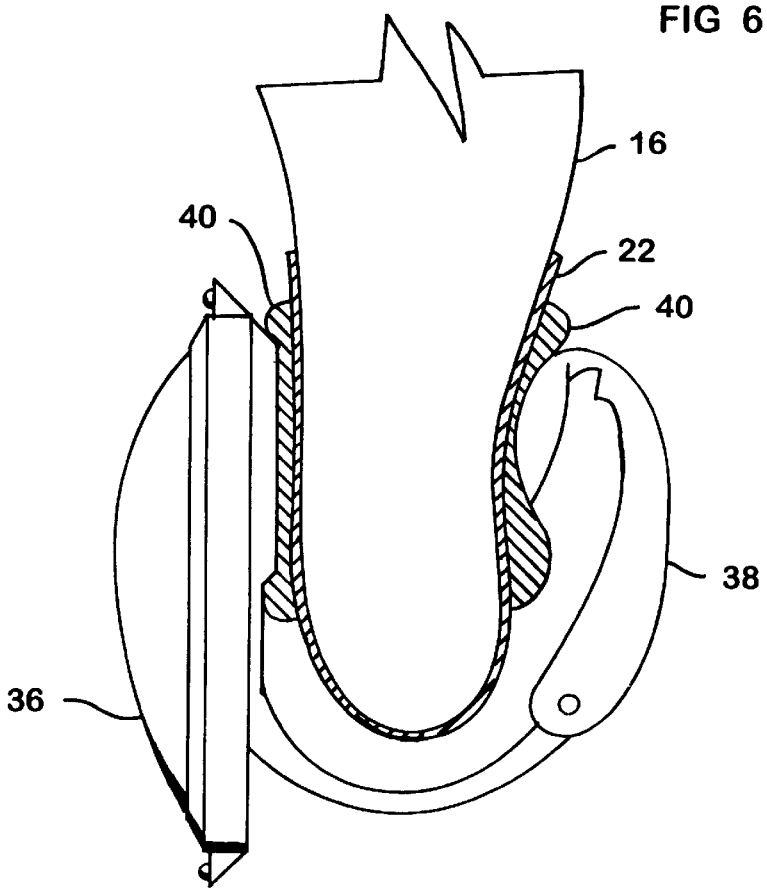

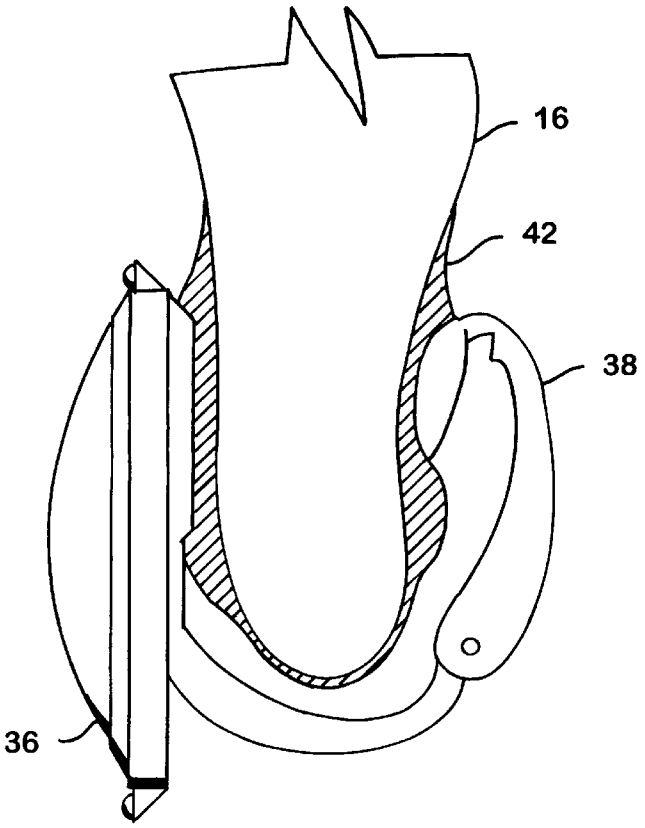
FIG 7
FIG 8
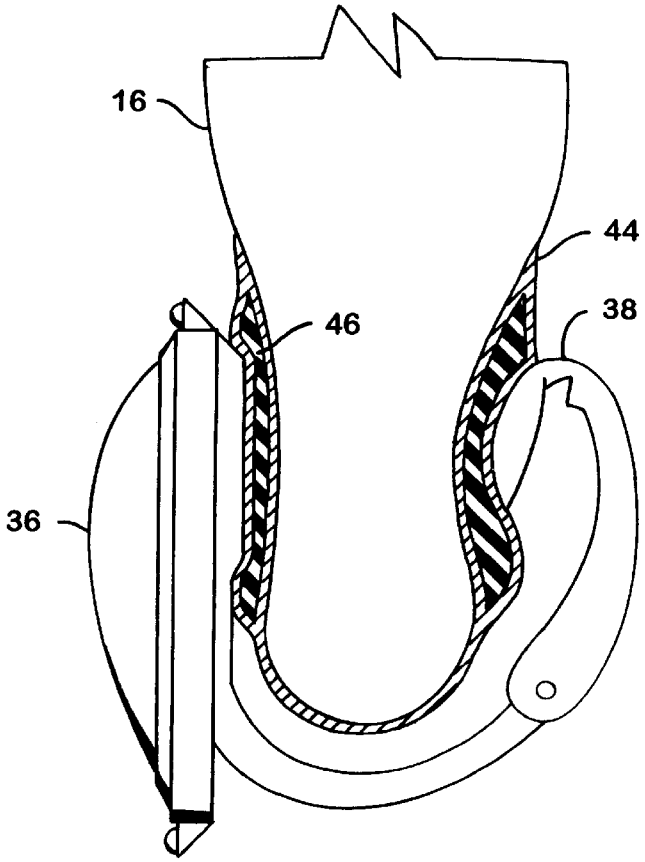

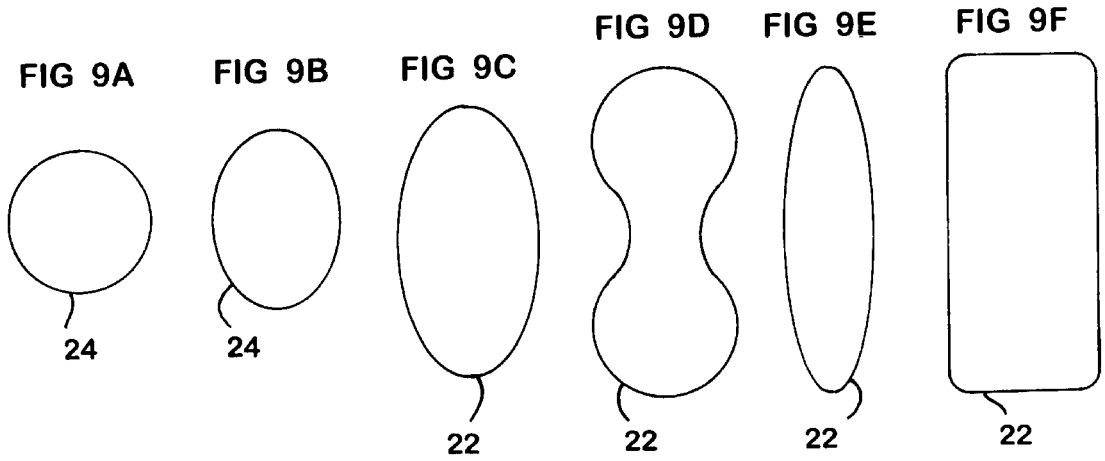
FIG 9A
FIG 9B
FIG 9C
FIG 9D
FIG 9E
FIG 9F
24
24
22
22
22
22
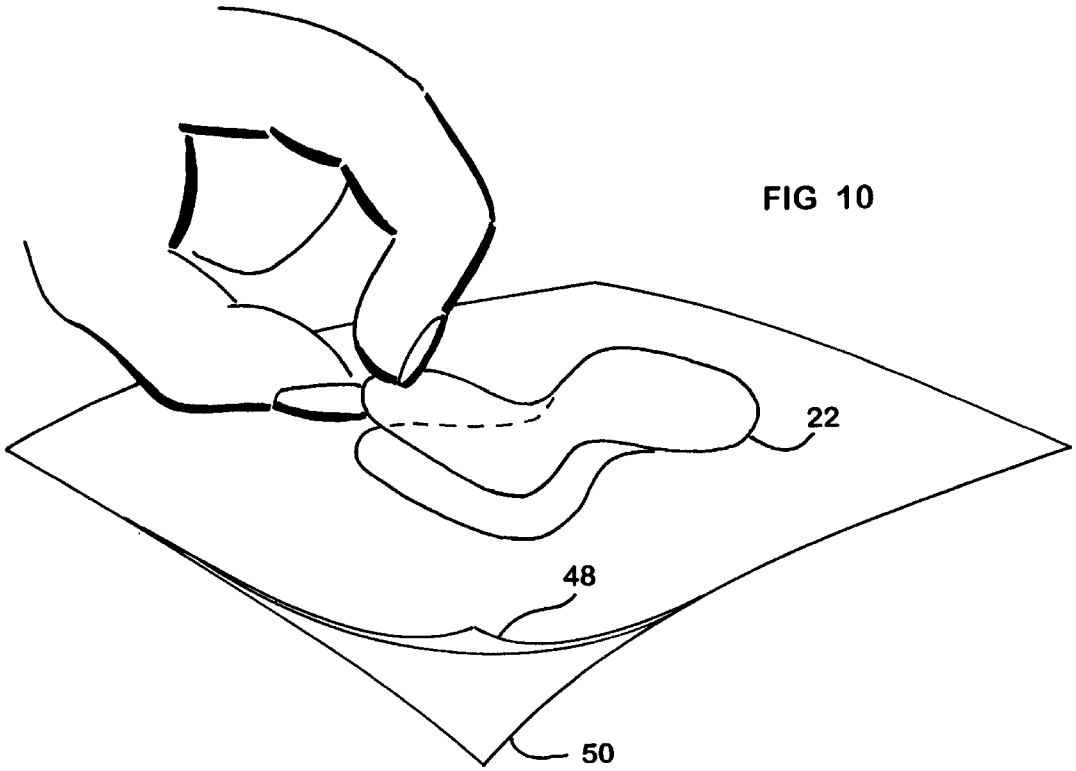
FIG 10
22
48
50

HUMAN EARLOBE PROTECTOR

This application is a continuation of 08/617,035, filed Mar. 18, 1996 now abandoned.

BACKGROUND

1. Field of Invention

This invention relates generally to a protector for the human earlobe, and more particularly to a reinforcement to prevent or temporarily repair the tearing of the earlobe by the weight of heavy pierced earrings, to minimize the pinching associated with clamp-type earrings, to allow the wearing of some styles of pierced-type earrings when the earlobes are not pierced, or to simulate the look of earrings without the necessity for holes pierced in the ears.

2. Description of Prior Art

Numerous people experience difficulty, discomfort and frequently disfiguring and painful injury from wearing earrings suspended from openings pierced through the earlobes. One source of problems with such pierced earrings is that the entire weight of the earring is transmitted through a post or stem of very small cross-sectional area which passes through the opening in the earlobe. Some earrings are heavy and over time, the result can be a downward tearing or shearing of the earlobe tissue. The hole may be enlarged to the extent that an earring will no longer be retained by the ear. It eventually may rip all the way through the bottom of the earlobe, such that no hole exists but rather two flaps of skin upon which the wearing of any type of earring becomes impossible. Correction of this damage requires an expensive plastic surgery procedure, and even afterwards the ear tissue may be forever weakened in this area.

While there are many kinds of earrings that do not require holes pierced in the earlobes, they are retained on the ear by means of spring-loaded or screw-adjustable clamps which pinch the soft tissue of the earlobe in their jaws. Wearers of this type of earring experience discomfort and possible injury from the prolonged compression of the tissue. Furthermore, people will attempt to wear clamp or clip-type earrings on earlobes already damaged from wearing pierced earrings. Additional injury is often the result.

There also exists a very real danger to children of infection and injury as a result of having their ears pierced at an early age. Young children often may not properly care for what is essentially an open wound created in the earlobe, thus making infection more likely. Physical injury is always a possibility as a result of snagging either the earring or the opening itself during play.

While there are several devices which deal with pierced earlobes in general, the prior art has not recognized or dealt with tendency of the post or stem of the pierced earring to travel downward through the bottom of the earlobe in response to gravity. Although the problem has been partially addressed by the increasing availability of extremely lightweight earrings, the lighter-weight materials don't provide the glamour associated with precious metals and stones; and the cosmetic effect is diminished from that provided by more traditional earrings. There has been no attempt to structurally reinforce the earlobe.

The patent to Baker, U.S. Pat. No. 161,853 is a device to prevent an open-stemmed earring from climbing out of the earlobe. The patents to Spicher, U.S. Pat. No. 2,568,207; Abramowitz, U.S. Pat. No. 3,500,829; and Shein, U.S. Pat. No. 3,257,223 are surgical instruments intended to remain in the lobe only while it heals and not while an earring is being worn. The patent to Ivey, U.S. Pat. No. 4,067,341 is a device to protect from allergic reaction but provides no structural reinforcement to the earlobe tissue. The patents to Cuvar et al, U.S. Pat. No. 4,593,540; Beam et al, U.S. Pat. No. 4,774,817; and Didomenico, U.S. Pat. No. 4,829,788 are methods or means of non-allergenic earring construction. The patent to Fountoulakis, U.S. Pat. No. 4,501,050 is simply a clutch-type retainer for a post-type earring.

There are several pad-type devices that provide some cushioning for clamp-type earrings, but the pads attach to the clamps of the earring themselves and, as the surface that contacts the ear is somewhat slick, the entire assembly tends to slip off the ear.

Some self-adhesive ear decorations are available for children but do not simulate actual earrings. The materials from which they are constructed and their accompanying adhesives give these decorative stickers a useful lifespan of minutes and as such they have no value as anything other than children's novelties.

I am unaware of any product that allows the wearing of pierced-type earrings without the necessity for holes in the earlobes. Thus, there presently exists a need for a means to conveniently and effectively remedy the above described situations that have been ignored by the prior art.

OBJECTS AND ADVANTAGES

The present invention recognizes the tendency of a heavy pierced earring to injure the hole in the ear by stretching and tearing and also recognizes the possibility of a tearing injury to occur in children with pierced ears as a result of play, and further recognizes the inability of an earlobe so damaged to support the wearing of any kind of earring without discomfort or further injury. Accordingly, several objects and advantages of the present invention are:

(a) to provide a cosmetically pleasing means to temporarily reinforce the human earlobe in order to prevent the downward tearing injury associated with the wearing of heavy pierced earrings. The reinforcement is accomplished by adhering a pre-formed article to the earlobe, constructed in such a way as to allow the weight of the earring to be transferred by said article away from the bottom of the pierced hole and distributed into the surrounding tissue.

(b) to temporarily repair an earlobe that has already been torn completely through into two flaps, or the hole of which has been enlarged to such a degree that the wearing of pierced earrings would not otherwise be possible. The repair is accomplished as above, by adhering to the earlobe a pre-formed article having sufficient strength in shear to provide total vertical support for the weight of an earring at the post. The article forms a structural bridge of the injury and allows the earring post to be inserted in a position close to the original pierced hole, and distributes the weight into the surrounding tissue.

(c) to provide a cushioning effect to enhance the comfort of wearing clip-type earrings.

(d) to provide a means by which some types of pierced earrings may be worn by those without pierced ears.

(e) to provide a means to simulate the look of earrings without the dangers of injury or infection posed by pierced ears, or the discomfort of clip-type earrings.

Further objects and advantages are to provide the above articles that conform well to the shape of the ear, blend into the surrounding skin color, remain comfortably attached to the earlobe for a useful period and through several changes of earrings, are easy and convenient to apply, are easy to remove, are provided ready to use on a roll or peel-off backing, are economically feasible to manufacture and are constructed to be disposable after use and so made of material that renders them relatively inexpensive. Still further objects, advantages and novel features of the present invention will become apparent from a consideration of the following description and drawings.

DRAWING FIGURES

In the drawings, closely related figures have the same number but different alphabetic suffixes.

FIG. 5 shows an enlarged cross section of the invention as shown in FIG. 1, supporting a heavy earring.

FIG. 6 shows a similar reinforcement provided with an integral padding means.

FIG. 7 shows a cross section of similar padded reinforcement, composed of varying thickness and density.

FIG. 8 shows a cross section of a padded reinforcement with a pre-formed pocket encompassing a gel filling.

FIGS. 9A to 9F show various plan shapes of a reinforcement.

FIG. 10 shows a reinforcement according to the present invention provided on a peel-off carrier backing.

REFERENCE NUMERALS IN DRAWINGS

Figure 1:
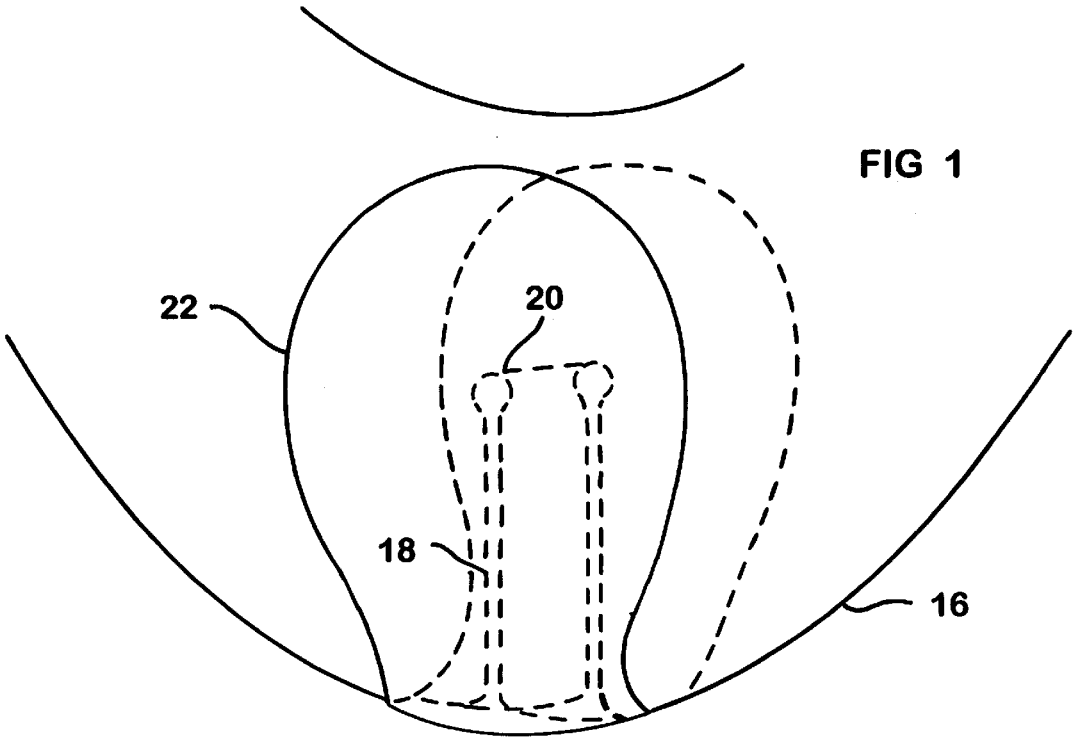
FIG. 1 shows an enlarged fragmentary perspective of the article according to the present invention, applied as a reinforcing repair of a torn-through human earlobe, covering both inner and outer surfaces of the earlobe and wrapping around the bottom.

16
earlobe

18
tear in earlobe

20
pierced hole in earlobe

22
reinforcing material shaped to wrap around bottom of earlobe

24
circular or oval reinforcement for uninjured pierced holes

26
earring post

28
pierced-type earring back or retainer

30
pierced-type earring decorative element

32
large downwead force vector

34
small downward force vectors

36
clip-type earring decorative element

38
clip-type earring clip

40
pre-formed padding element

42
integral padding reinforcement

44
pre-formed reinforcement with integral pocket

46
gel filling

48
self-adhesive sheet material

50
peel-off carrier backing

52
downward extension for accepting earring post

54
downward extension incorporating integral decorative element

DESCRIPTION

FIGS. 1 to 9, 13, 14

A typical embodiment of the present invention applied as a reinforcement to a torn-through earlobe is illustrated in FIG. 1. The reinforcement 22 is positioned on and adhered to the earlobe 16 in such a way as to bridge the tear 18 in the lobe, and allow insertion of an earring post at the location of the original hole 20 pierced in the lobe for the purpose. In the preferred embodiment, the reinforcement is pre-formed from a transparent, flexible, breathable and self-adhesive material such as 3M Transpore 1527 or 1527S (available from the 3M Healthcare Division, Bldg. 275, 4-E08, St. Paul, Minn. 55144). However, the reinforcement can be fabricated of any other material that is transparent, self-adhesive, and flexible enough to conform to the shape of the region of the earlobe as pictured.

Figure 2:
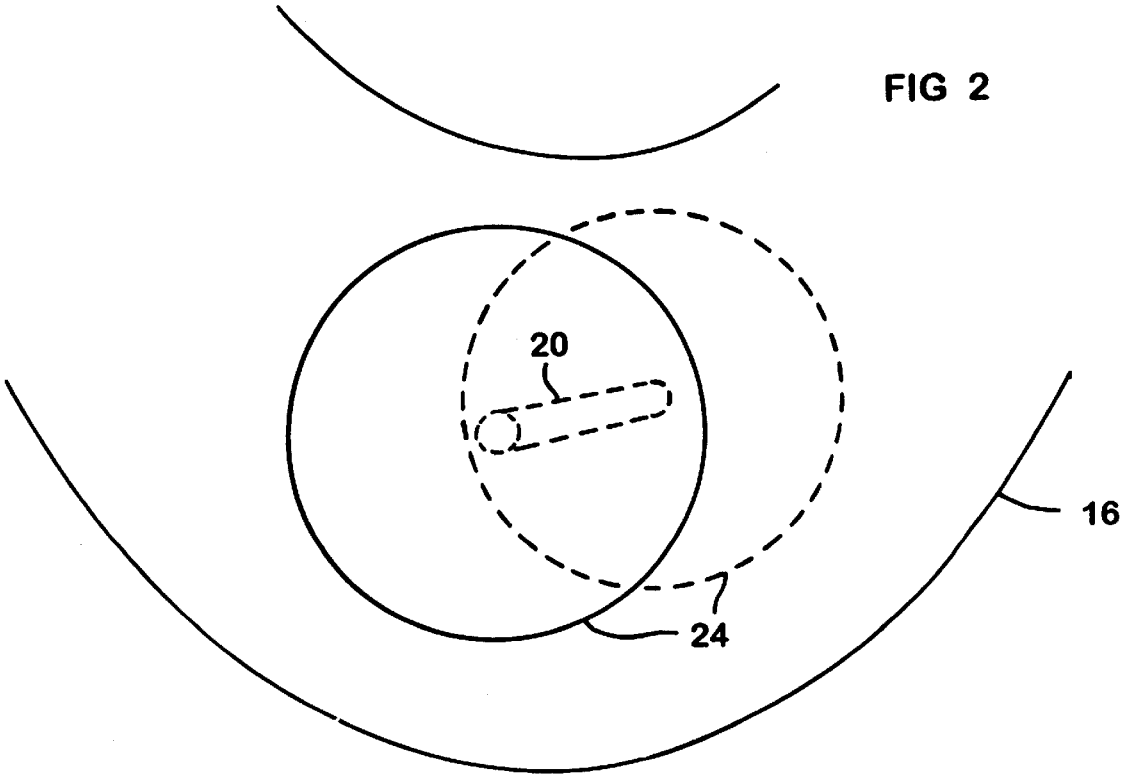
FIG. 2 shows circular reinforcements of an uninjured pierced earlobe.

An additional embodiment is shown in FIG. 2 where the reinforcements 24 are essentially circular or oval and applied separately to both inner and outer surfaces of the earlobe 16 surrounding the normal pierced hole 20.

Figure 3:
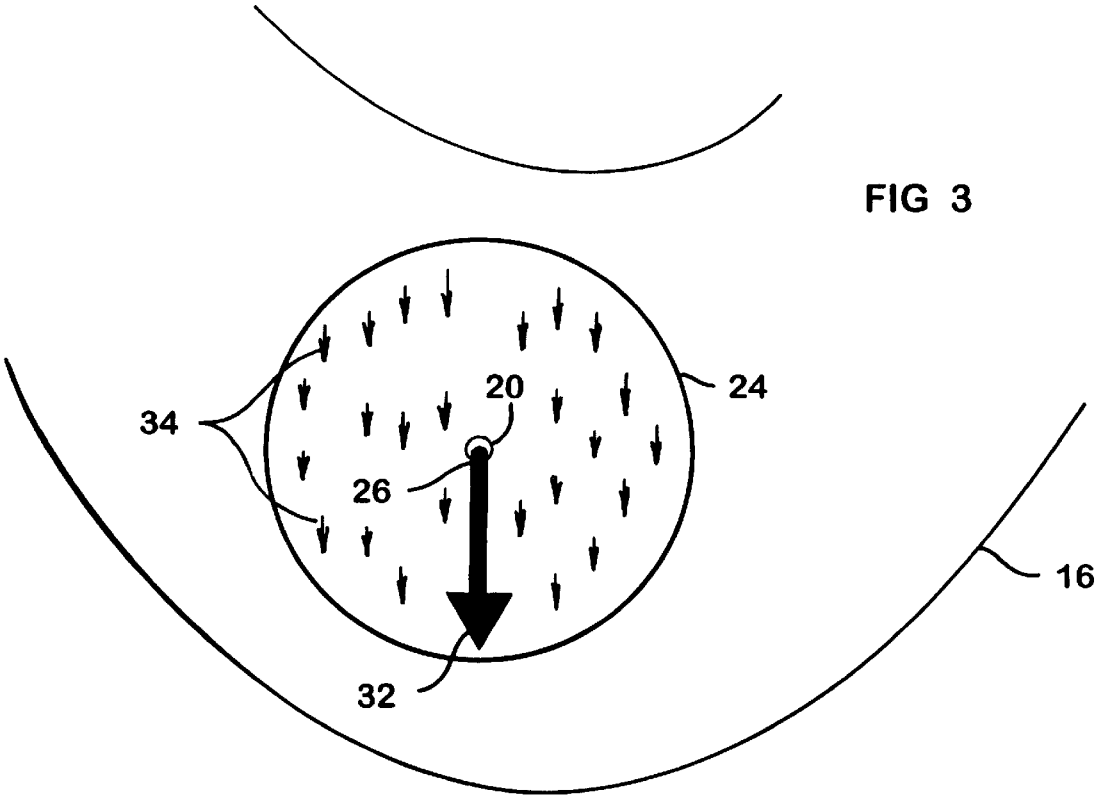
FIG. 3 shows representation of forces applied to an earlobe.

FIG. 3 illustrates how the large vertical load 32 from a heavy earring is normally fed from the earring post 26 into the bottom of the hole 20 pierced in the soft tissue of the earlobe 16. Reinforcement 24 transmits this relatively high-point load into very small forces 34 spread over an area much larger than the bottom of pierced hole 20 and effectively prevents the downward ripping that would otherwise occur over time.

Figure 4:
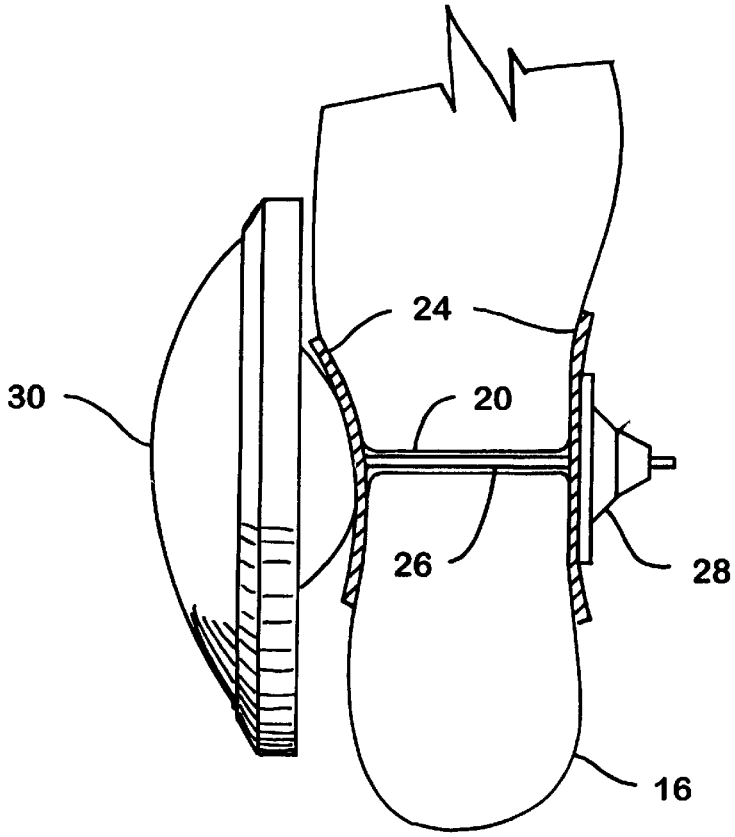
FIG. 4 shows an enlarged cross section of the invention as shown in FIG. 2, supporting an earring.
Figure 11:
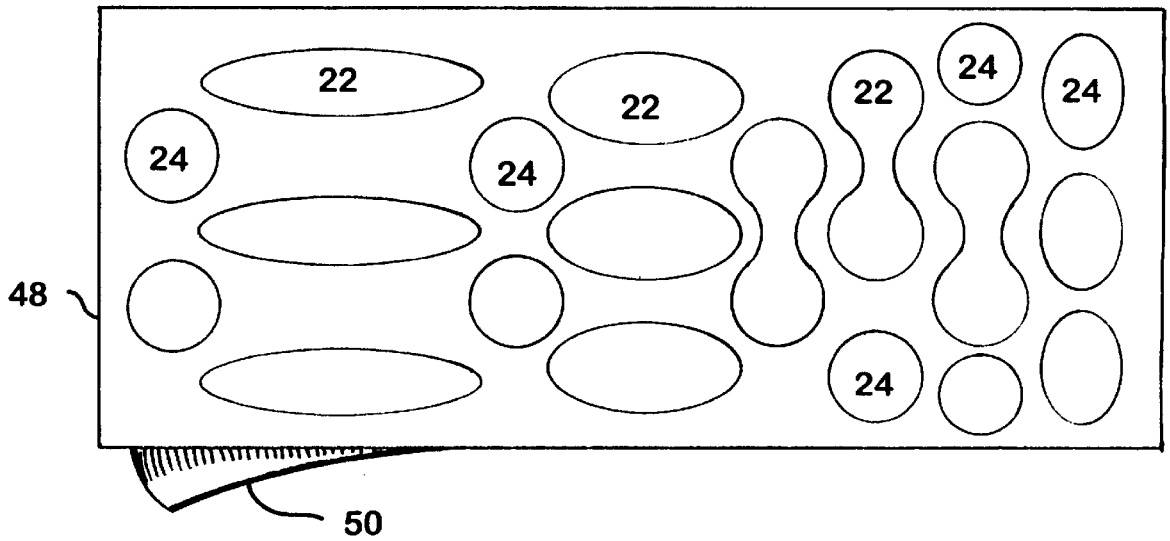
FIG. 11 shows multiple pre-formed reinforcements provided on a peel-off carrier backing.

FIG. 4 further illustrates the reinforcement 24 as introduced in FIG. 2, the plan shapes of which are similar to those depicted in FIGS. 9A and 9B. The disposition of the components of a typical pierced earring 30, its post 26, and a back or retainer 28 relative to the aperture 20 pierced in the earlobe 16 and the reinforcement 24 of the present invention is clearly depicted.

FIG. 5 further illustrates the embodiment of the invention as introduced in FIG. 1 where additional reinforcement is desired due to the weight of a heavier earring 30 or necessary due to damage to the earlobe. The plan shape for the reinforcement 22 would be similar to those illustrated in FIGS. 9C, 9D, 9E and 9F.

FIG. 6 depicts a typical embodiment of the invention provided with pre-formed and attached padding means 40 to soften the pinching of the earlobe 16 between the body 36 and the clip 38 of a typical clip-type earring.

There are various possibilities regarding the construction of the padding means of this embodiment. In FIG. 6, padding means 40 is fabricated of a foam rubber or soft plastic material and pre-attached to a reinforcement 22 as depicted in FIGS. 1 and 5. FIG. 7 shows a similar padded reinforcement wherein the padding means 42 and the reinforcement are integral and formed in one piece by molding or some other process of a material of varying thickness and/or density. Note that this embodiment would have a plan shape similar to FIGS. 9C–9F but that separate inner and outer padding devices could be formed from shapes similar to FIGS. 9A and 9B. Also, note that this embodiment of the device could be used additionally with post-type earrings 30 as shown in FIGS. 4 and 5. FIG. 8 shows an additional possibility for this embodiment wherein the device comprises a hollow membraneous shell 44 filled with a gel or gel-like material 46.

Figure 13:
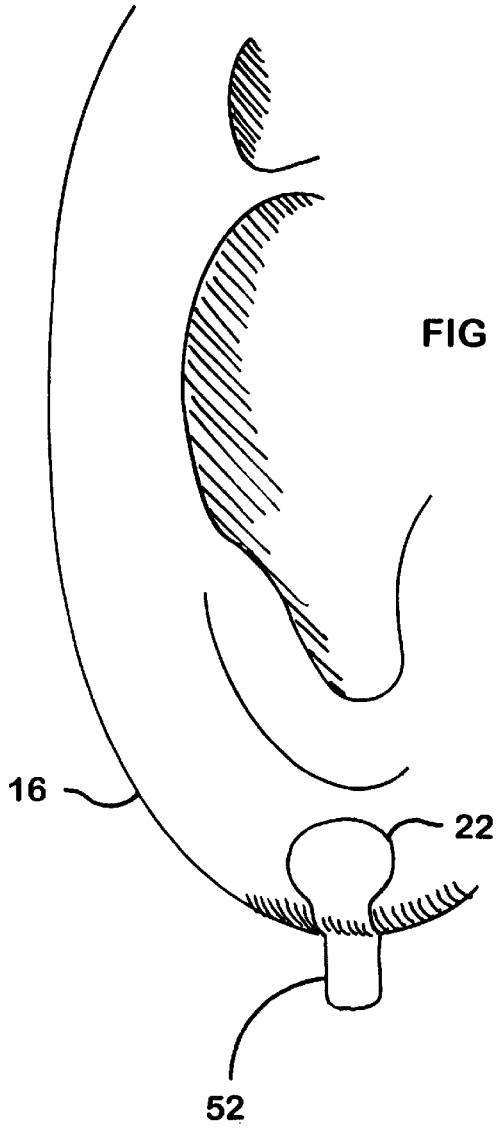
FIG. 13 shows a reinforcement provided with a downward extension.

FIG. 13 shows an embodiment of the present invention wherein the self-adhesive reinforcement 22 is additionally provided with a downward extension 52 which can accept the post of an earring below the earlobe 16, thus eliminating the necessity of an aperture in the tissue of the ear.

Figure 14:
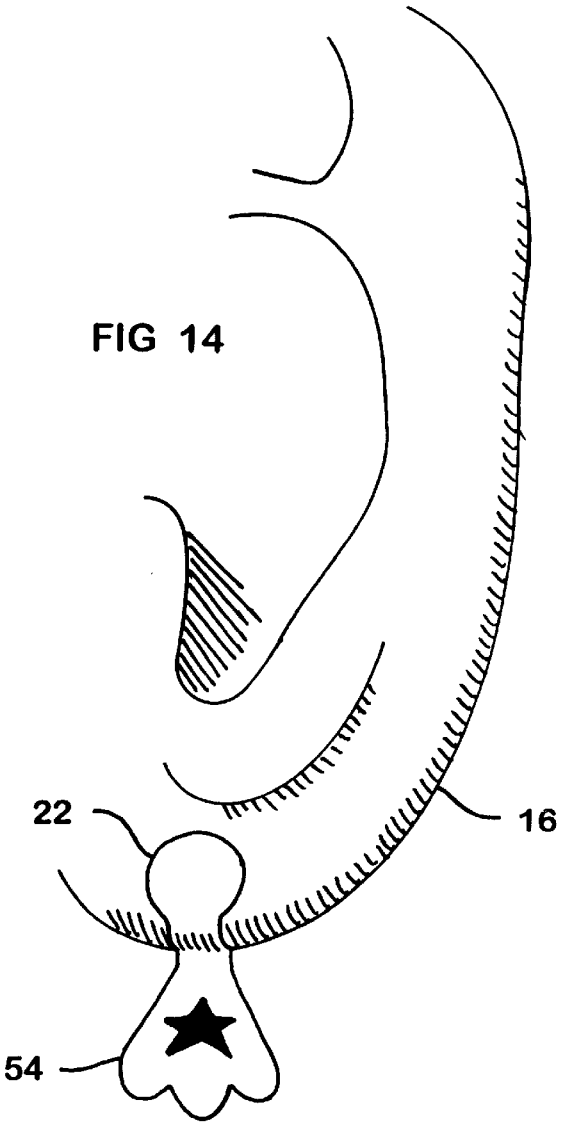
FIG. 14 shows a reinforcement with a downward extension additionally provided with a decorative element.

FIG. 14 depicts an additional embodiment further comprising a decorative downward extension 54 so constructed as to simulate the appearance of an actual earring.

Operation

FIGS. 1–14

Figure 12:
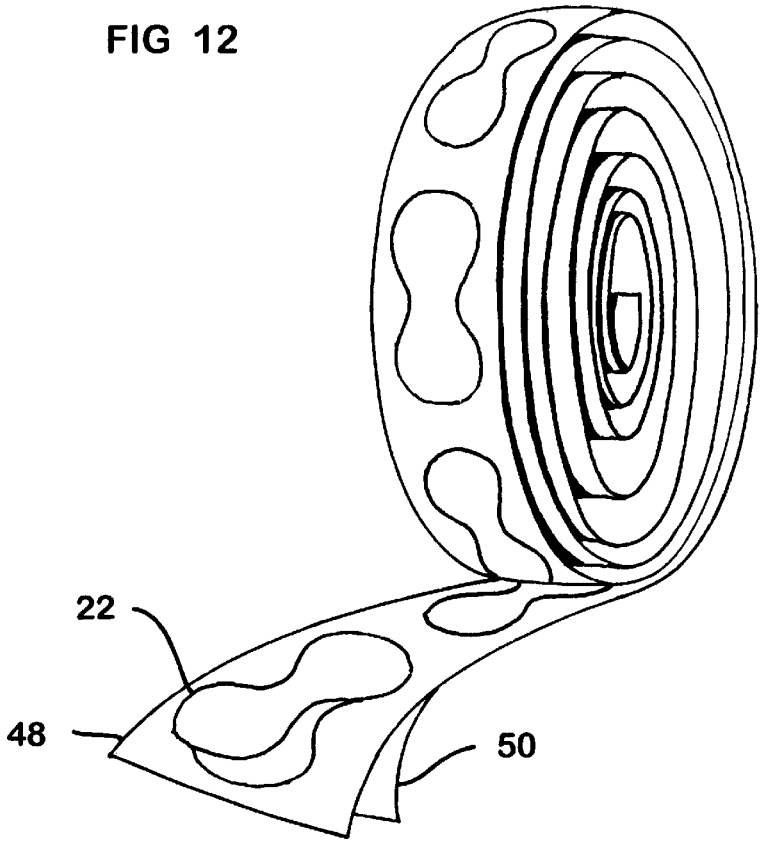
FIG. 12 shows multiple reinforcements provided on a peel-off backing in the form of a roll.

The manner of using each of the articles herein described is similar with some minor differences affecting specific applications. Where no damage to the earlobe has occurred, but the earlobe is pierced and the user desires to wear post-type earrings in the customary position, the article 24 depicted in FIGS. 2 and 4 is selected from a peel-off carrier backing 50 as depicted in FIG. 10 in sheet form and FIG. 12 as a roll. The adhesive-coated side of a reinforcement 24 is placed in contact with the outer surface of the earlobe 16 roughly centered on the pierced aperture 20, another reinforcement 24 placed similarly on the inner surface of the earlobe and both gently pressed to assure good adhesive bonding to the skin. As the material is transparent, the location of the pierced aperture 20 is readily apparent. The material of the reinforcement 24 is easily pierced by the stem 26 of the earring 30 which is gently pushed through the pierced aperture 20 in the earlobe 16, through the remaining reinforcement 24, and the earring back 28 which is attached in the customary manner.

Where damage to the earlobe has occurred as shown in FIG. 1 or where additional reinforcement is desired, the reinforcement 22 is selected and applied in a manner identical with that for reinforcement 24 above, except that only one is needed and with additional care being given to the positioning of the article such that the damage 18 is effectively beidged by the portion of the article wrapping around the bottom of the earlobe 16. Much esperimentation has demonstrated conclusively that this positioning can be accomplished easily and repeatedly. The earring post 26 is inserted in a position close to the original pierced aperture 20 and the back 28 is assembled in the usual manner.

Application of the embodiments of the invention depicted in FIGS. 6, 7 and 8 is identical with that described above, with the addition that the padded area 40, 42 and 46 is placed on the region of the earlobe 16 normally gripped by the body 36 and clip 38 of a clip-type earring which then is applied in the customary manner.

Application of the embodiments of the invention shown in FIGS. 13 and 14 is identical, consistent with the placement of conventional earrings.

Removal is identical in all cases. After the earrings are worn and removed in the normal manner, then the reinforcement device is gently peeled from the earlobe and discarded. It should be emphasized that much experimentation has shown that anyone with normal motor skills can use with ease the herein presented invention as described.

SUMMARY, RAMIFICATIONS, AND SCOPE

From the description herewith, a number of advantages of the present invention become evident.

(a) A reinforcing device for the soft earlobe tissue normally pierced to receive the post of an earring will prevent the downward tearing of said tissue due to the wearing of heavy pierced earrings and thus reduce the pain and discomfort and counter the need for surgical correction of the damage.

(b) Where damage to the earlobe has already occurred, a reinforcing device can effectively repair temporarily the earlobe to a condition where pierced earrings may again be worn prior to surgical repair, and can prevent additional damage to the earlobe.

(c) A reinforcing device provided with a padding means can substantially reduce the discomfort associated with the prolonged wearing of clip-type earrings and can allow the wearing of same on an earlobe injured as above.

(d) A reinforcing device provided with a suitable extension can allow the wearing of certain pierced-type earrings on non-pierced ears, thus cancelling the need for piercing and preventing the herein described injury.

(e) An adhesive-reinforcing device incorporating suitable decorative elements or designs can effectively simulate the appearance of traditional earrings with the accompanying advantages described in (d) above.

Furthermore, all of the above described objects and advantages may be achieved by an article that is inexpensive, disposable, easy to manufacture, convenient and safe to use and is cosmetically and aesthetically pleasing.

In closing, the aspects of the herein described invention that prevent pain and injury cannot be over-emphasized.

Although the description above contains many specificities, these should not be construed as limiting the scope of the invention but as merely providing illustrations of some of the presently preferred embodiments of this invention. For example, the reinforcement can have other shapes, and the construction can be of varying materials, etc.

Thus the scope of the invention should be determined by the appended claims and their legal equivalents, rather than by the examples given.

I claim:

1. A method for temporarily repairing a cleft earlobe or an earlobe with an enlarged hole while supporting a heavy pierced or post type earring on a cleft earlobe comprising the steps of:

providing a pliant, polymeric, transparent, non-allergenic, breatheable, easily pierceable strip having opposite sides, one of said sides coated with a pressure-sensitive acrylate adhesive allowing secure but removeable adhesion of said strip to immediate anterior and posterior regions of vertical tear or cleft on lateral, inferior, and medial surfaces of said earlobe;

affixing said adhesive-coated strip to the cleft or enlarged hole earlobe, so as to connect the two flaps of earlobe tissue on either side of cleft, wrapping around the bottom and extending up the back side of the earlobe to a location slightly above the area of the original pierce, said strip being capable of supporting a heavy earring applied vertically in shear to said strip by an earring post; and inserting the said post of a post or pierced type earring in the location of the original pierce in the customary manner but with sufficient force that said strip is pierced by said post on both lateral and medial planes of the earlobe, forming a tight-fitting custom aperture for said post, thus distributing the weight of said earring into healthy tissue surrounding said cleft through said adhesive strip.

* * * * *